US011654700B2

(12) United States Patent
Nakamura

(10) Patent No.: US 11,654,700 B2
(45) Date of Patent: May 23, 2023

(54) PRINTER AND METHOD FOR PRINTING

(71) Applicant: Ricoh Company, Ltd., Tokyo (JP)

(72) Inventor: Kahei Nakamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/941,734

(22) Filed: Jul. 29, 2020

(65) Prior Publication Data

US 2021/0046772 A1 Feb. 18, 2021

(30) Foreign Application Priority Data

Aug. 13, 2019 (JP) ..... JP2019-148323
Jul. 22, 2020 (JP) ..... JP2020-125716

(51) Int. Cl.
*B41J 11/00* (2006.01)
*B41J 25/00* (2006.01)

(52) U.S. Cl.
CPC ..... *B41J 11/0065* (2013.01); *B41J 25/001* (2013.01)

(58) Field of Classification Search
None
See application file for complete search history.

(56) References Cited

U.S. PATENT DOCUMENTS 7,533,959 B2 * 5/2009 Ouchi ..... B41J 11/0025 347/101
8,672,439 B2 * 3/2014 Suzuki ..... B41J 11/0095 347/16
8,672,442 B2 * 3/2014 Endo ..... B41J 11/0065 347/19
8,783,817 B2 * 7/2014 Higashitani ..... B41J 11/0065 347/19
2008/0024808 A1 1/2008 Masuda
2011/0210498 A1 * 9/2011 Higashitani ..... B41J 11/0065 271/110
2014/0376063 A1 12/2014 Sasa

FOREIGN PATENT DOCUMENTS

JP 2007-219407 8/2007
JP 2008-032913 2/2008

* cited by examiner

*Primary Examiner* — Alejandro Valencia
(74) *Attorney, Agent, or Firm* — Xsensus LLP

(57) ABSTRACT

A printer includes a printing device to print an image on a sheet, a carriage mounting the printing device, the carriage to scan in a main-scanning direction, a detector on the carriage, the detector to detect a presence and an absence of the sheet, and circuitry to detect an edge position of the sheet in the main-scanning direction based on a detection result by the detector while the printing device prints a first scan of the image on the sheet, adjust a print start position at which the printing device starts printing a second scan of the image on the sheet based on the edge position detected in the first scan, and control the printing device to print the second scan of the image from the print start position.

16 Claims, 8 Drawing Sheets

PRINTER AND METHOD FOR PRINTING

CROSS-REFERENCE TO RELATED APPLICATIONS

This patent application is based on and claims priority pursuant to 35 U.S.C. § 119(a) to Japanese Patent Application No. 2019-148323, filed on Aug. 13, 2019, in the Japan Patent Office and Japanese Patent Application No. 2020-125716, filed on Jul. 22, 2020, in the Japan Patent Office, the entire disclosures of which are hereby incorporated by reference herein.

BACKGROUND

Technical Field

Aspects of the present disclosure relate to a printer and a method for printing.

Related Art

A printer moves a carriage mounting a head that discharges a liquid to print an image. If a skew occurs during a conveyance of a sheet such as a web in the printer, an image position deviates from an edge of a sheet in a width direction.

The printer using a cut sheet includes a sensor to detect a position of the sheet in the width direction. The printer measures the position of a first sheet in the width direction conveyed a present time. Further, the printer adjusts a position of an image formation of a second sheet conveyed next time.

SUMMARY

In an aspect of this disclosure, a printer includes a printing device to print an image on a sheet, a carriage mounting the printing device, the carriage to scan in a main-scanning direction, a detector on the carriage, the detector to detect a presence and an absence of the sheet, and circuitry to detect an edge position of the sheet in the main-scanning direction based on a detection result by the detector while the printing device prints a first scan of the image on the sheet, adjust a print start position at which the printing device starts printing a second scan of the image on the sheet based on the edge position detected in the first scan, and control the printing device to print the second scan of the image from the print start position.

In another aspect of this disclosure, a method for printing an image on a sheet is provided, the method includes scanning a printing position in a main-scanning direction to print a first scan of the image on the sheet, detecting an edge position of the sheet in the main-scanning direction during the scanning, adjusting a print start position to start printing a second scan of the image on the sheet based on the edge position, and scanning the printing position to print the second scan of the image on the sheet from the print start position.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
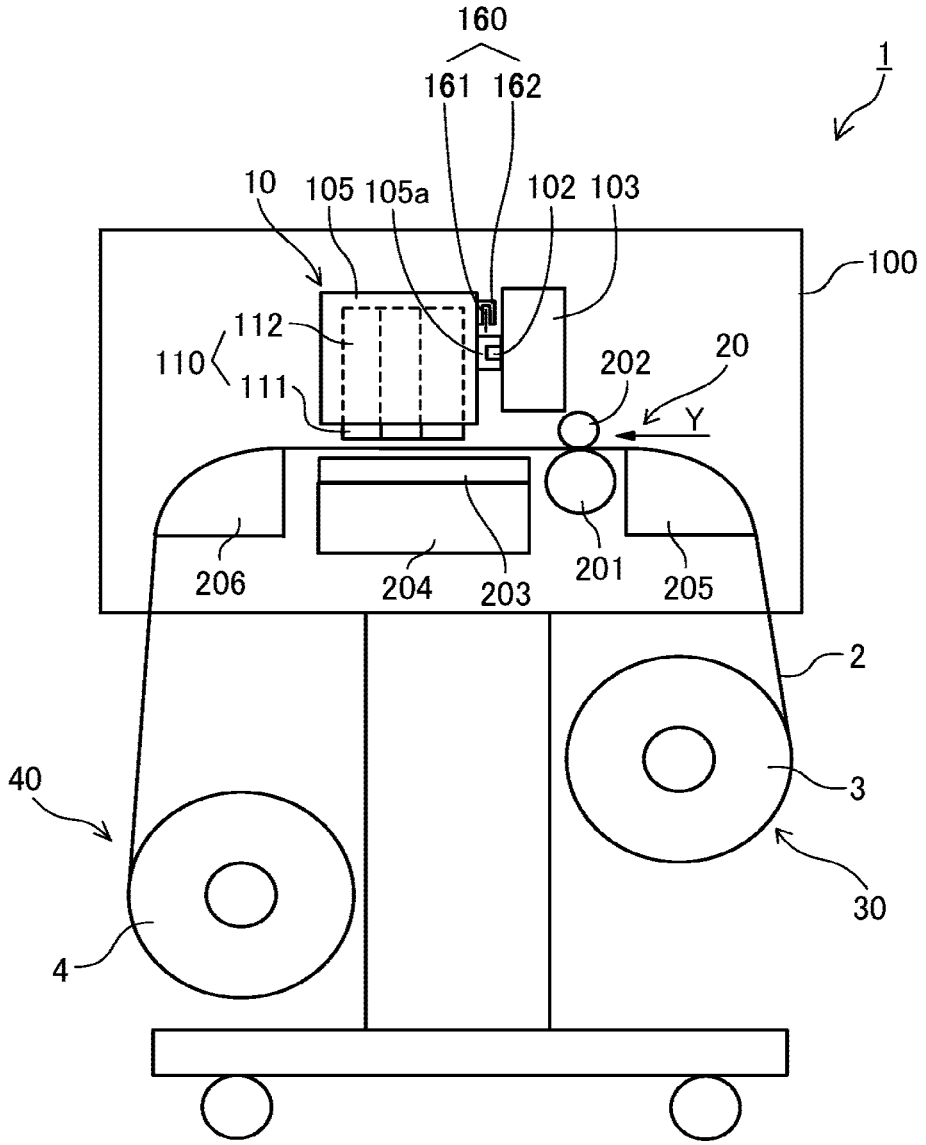
FIG. 1 is a schematic side view of a configuration of an example of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A printer as a liquid discharge apparatus according to a first embodiment of the present disclosure is described with reference to FIGS. 1 to 4.

Figure 2:
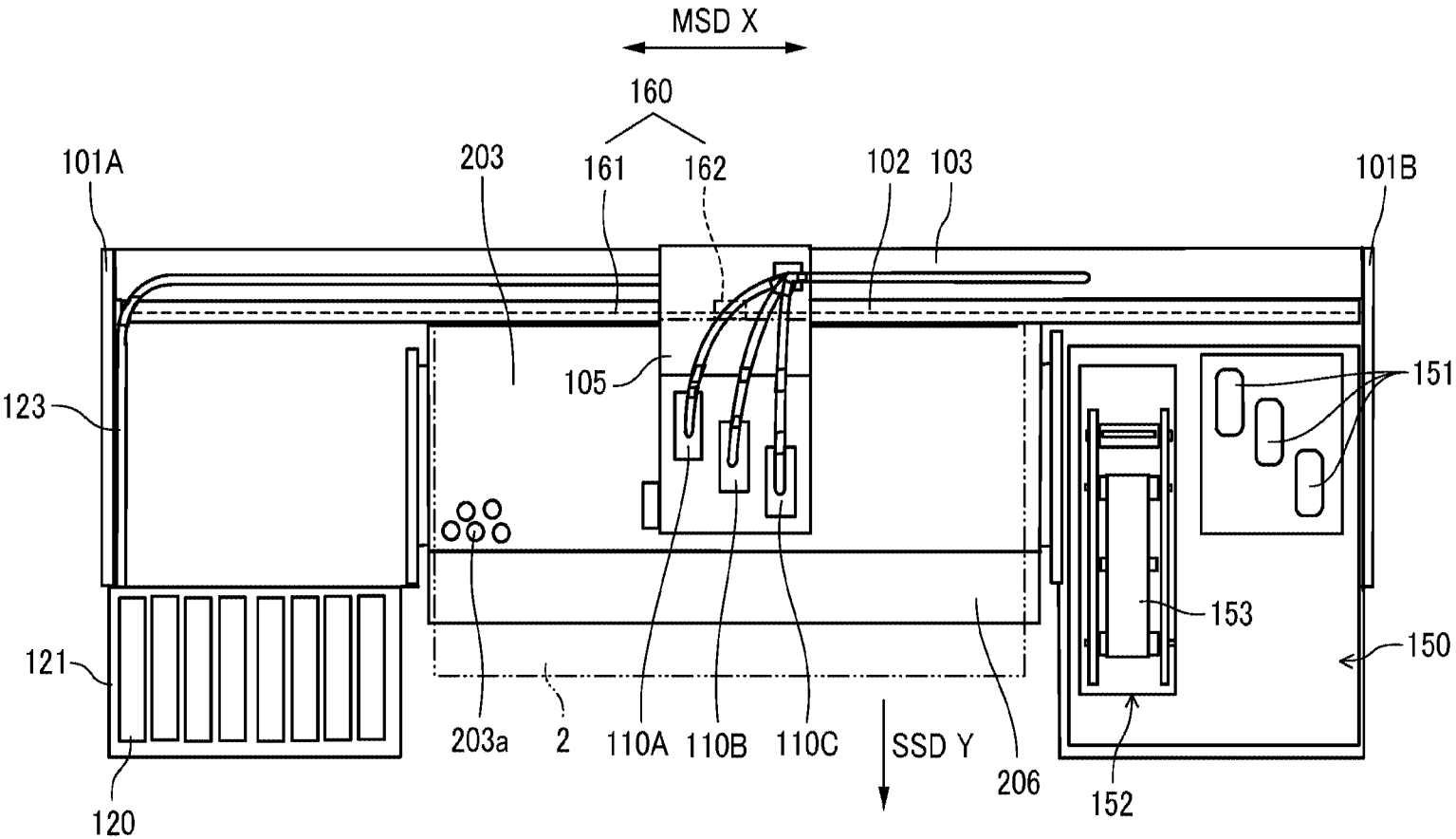
FIG. 2 is a schematic plan view of the liquid discharge apparatus of FIG. 1.
Figure 3:
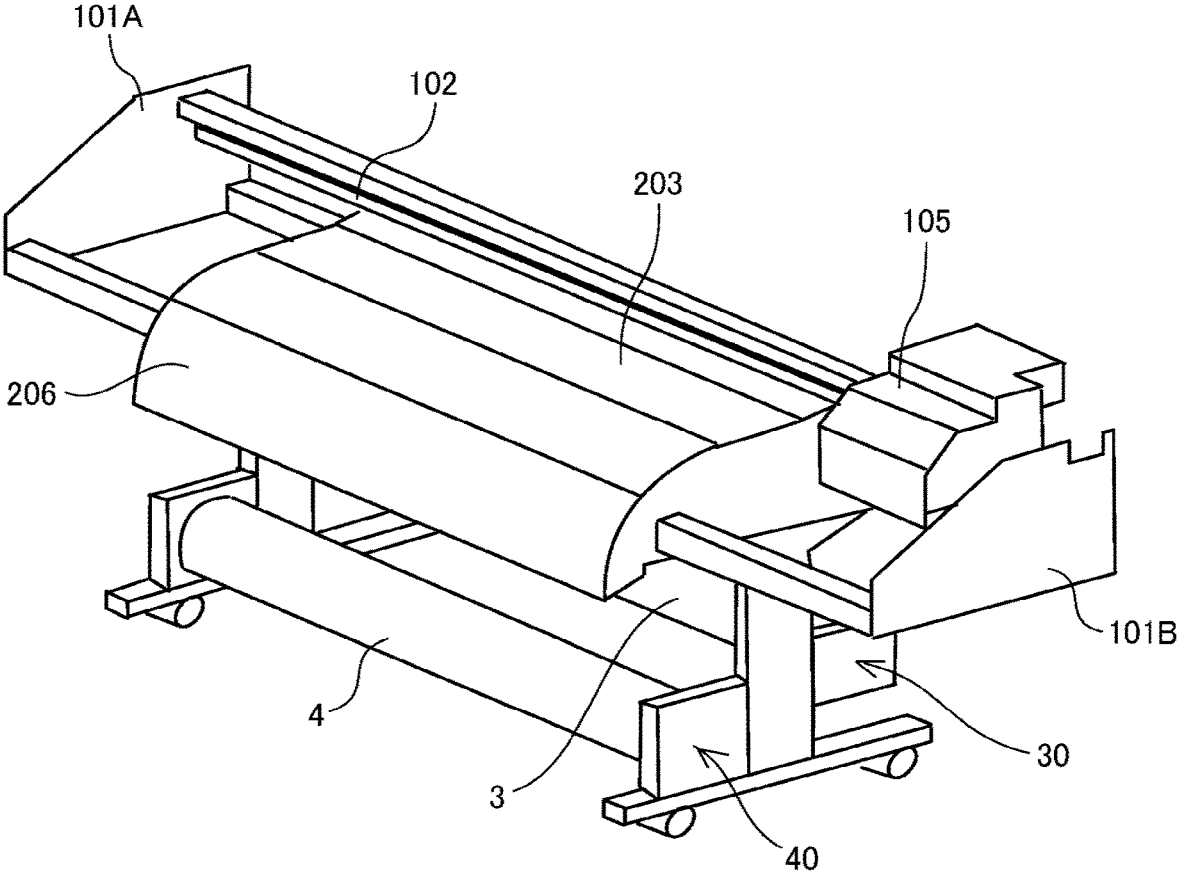
FIG. 3 is a schematic perspective view of a portion of the liquid discharge apparatus according to the first embodiment of the present disclosure.
Figure 4:
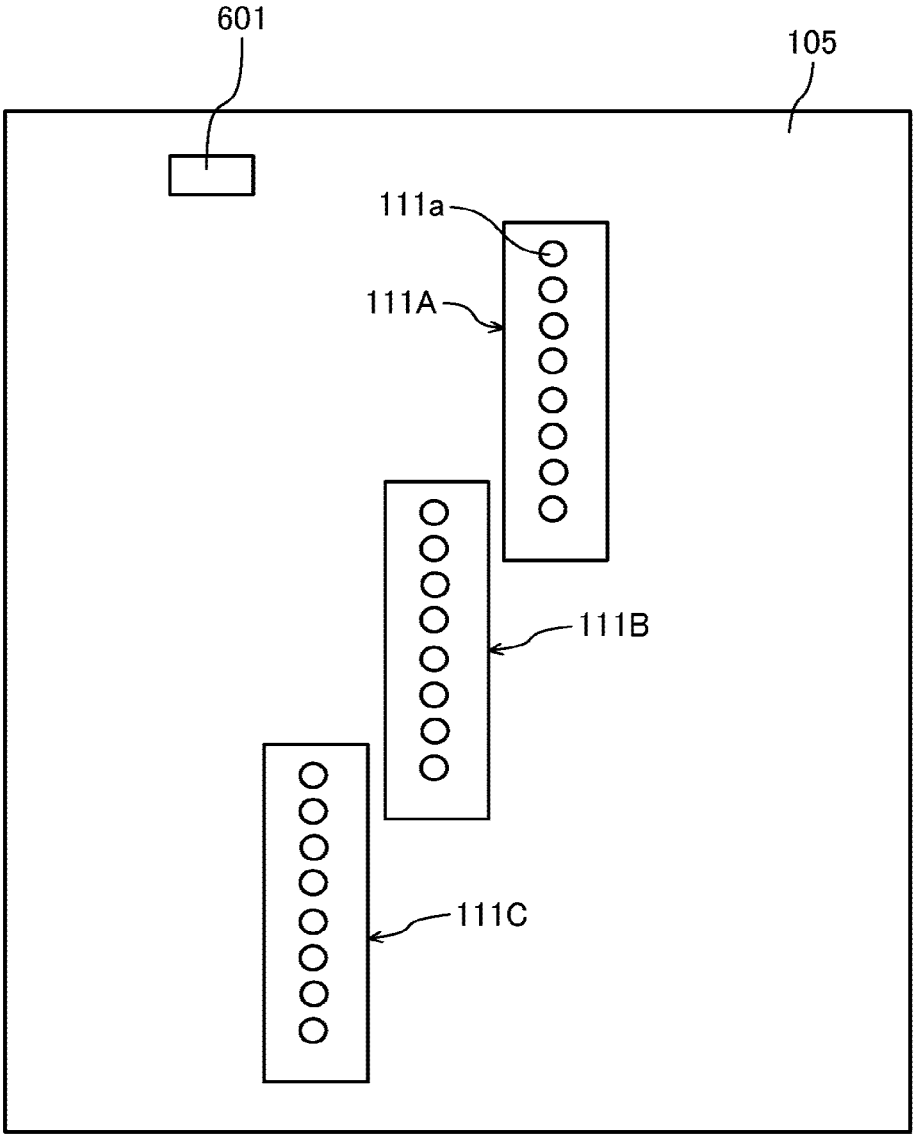
FIG. 4 is a schematic plan view of a head of the liquid discharge apparatus according to the first embodiment of the present disclosure.

FIG. 1 is a cross-sectional side view of the printer 1 according to an embodiment of the present disclosure. FIG. 2 is a plan view of the printer 1 of FIG. 1. FIG. 3 is a perspective view of a main part of the printer 1. FIG. 4 is a schematic plan view of a bed of the printer 1 according to the first embodiment of the present disclosure.

The printer 1 is a serial-type inkjet recording apparatus as a liquid discharge apparatus. The printer 1 includes a printing device 10 and a conveyor 20 in an apparatus body 100. The printing device 10 prints on a sheet 2 such as a roll paper, a continuous sheet, for example. The conveyor 20 conveys the sheet 2.

Further, the printer 1 includes a roll feeder 30 and a roll winder 40 outside the apparatus body 100. The roll feeder 30 accommodates a feeding roll 3 in which the sheet 2 is wound in a roll shape and feeds the sheet 2 to the printing device 10.

The roll winder 40 accommodates a winding roll 4 in which the sheet 2, onto which an image is printed by the printing device 10, is wound. The sheet 2 is wound in the roll shape in the winding roll 4.

The printing device 10 reciprocally movably holds and guides a carriage 105 in a main-scanning direction indicated by arrow "X" by a guide 102 attached to a stay 103 bridged across a left-side plate 101A and a right-side plate 101B. The main-scanning direction X is also referred to as a "first direction." The main-scanning direction X is also referred to as a "width direction" of the sheet 2. The carriage 105 is fitted to the guide 102 so that a fitting portion 105*a* formed on a back side of the carriage 105 is movably fitted to the guide 102. Thus, the carriage 105 reciprocally moves (scans) along the guide 102 in the main-scanning direction X (first direction).

The carriage 105 mounts three liquid discharge devices 110 (110A to 110C) as print devices. Each of the three liquid discharge devices 110 includes a liquid discharge head 111 as a liquid discharger and a sub tank 112 that supplies a liquid to the liquid discharge head 111. Hereinafter, the "liquid discharge head" is simply referred to as the "head." The liquid discharge device 110 includes the head 111 and the sub tank 112 formed as a single body.

Thus, the carriage 105 moves a printing position at which the head 111 discharges the liquid onto the sheet 2 in the main-scanning direction X.

As illustrated in FIG. 4, the head 111 includes a nozzle array in which a plurality of nozzles 111*a* to discharge a liquid is arrayed.

Thus, the three heads 111A to 111C are arranged at different positions in a staggered manner (see FIG. 4) in a conveyance direction of the sheet 2 (sub-scanning direction Y) as a second direction that intersects the main-scanning direction X as the first direction (width direction of the sheet 2). The conveyance direction (sub-scanning direction) indicated by arrow "Y" in FIG. 2.

In FIG. 4, a part of the nozzle 111*a* in one of the head 111 is overlapped with a part of the nozzle 111*a* in another head 111 at a joint between the heads 111.

Further, the carriage 105 mounts a sheet detector 601 to detect a presence and an absence of the sheet 2.

Further, the printer 1 includes a linear encoder sheet 161 and a linear encoder 160. The linear encoder sheet 161 is stretched along the main-scanning direction X. The linear encoder 160 includes an encoder sensor 162 to read the linear encoder sheet 161 to detect a position of the carriage 105.

The printer 1 includes a cartridge holder 121 detachably attach a plurality of main tanks 120 (liquid cartridges) containing liquids of respective colors on one end of the apparatus body 100. The cartridge holder 121 includes a liquid feed pump, etc., to supply liquid of the respective colors from the main tanks 120 to the heads 111 of the liquid discharge devices 110 via supply tubes 123 of respective colors. The main tanks 120 are detachably attached to the cartridge holder 121.

The conveyor 20 includes a conveyance roller 201 and a counter roller 202 as a conveyor on an upstream side of the printing device 10 in a sub-scanning direction of the sheet 2 indicated by arrow "Y" in FIG. 2. The conveyor 20 sandwiches the sheet 2 between the conveyance roller 201 and the counter roller 202 to convey the sheet to the printing device 10. The sub-scanning direction Y is also referred to as a "conveyance direction."

The conveyor 20 includes a platen 203 and a suction mechanism 204 (see FIG. 1). The platen 203 faces the head 111 to guide the sheet 2. The suction mechanism 204 attracts the sheet 2 through suction holes 203*a* of the platen 203. Although only a portion of the suction holes 203*a* is illustrated in FIG. 2, the platen 203 includes suction holes 203*a* formed all over an entire surface of the platen 203.

The conveyor 20 includes a conveyance guide 205 on an entrance side (right-side in FIG. 1) of the conveyor 20. The conveyance guide 205 guides, to the printing device 10, the sheet 2 fed from the feeding roll 3. The conveyor 20 further includes a conveyance guide 206 on an exit side (left-side in FIG. 1) of the conveyor 20. The conveyance guide 206 guides, to the winding roll 4, the sheet 2 on which an image is printed by the printing device 10.

The printer 1 includes a maintenance unit 150 to maintain and recover a discharge function the head 111. The maintenance unit 150 is disposed on one side (right-side in FIGS. 2 and 3) of the printer 1 in the main-scanning direction X of the carriage 105.

The maintenance unit 150 includes, for example, a cap 151 to cap a nozzle surface of the head 111 and a wiper 152 including a web 153 to wipe the nozzle surface of the head 111.

In the printer 1, the conveyance roller 201 and the counter roller 202 conveys the sheet 2 in the sub-scanning direction Y (conveyance direction) while the sheet 2 is attracted to the platen 203.

Therefore, for example, the printer 1 drives the head 111 in accordance with print signals while moving the carriage 105 in the main-scanning direction X to discharge a liquid of a desired color onto the sheet 2 stopped to print one line. Then, the printer 1 repeatedly feeds the sheet 2 by a predetermined distance and then prints next line of the image. The above-described operations of feeding and printing are repeated to form a desired image on the sheet 2, and then the sheet 2 is ejected to the winding roll 4 to perform single-pass printing. The printer 1 repeatedly scans the carriage 105 and conveys the sheet 2 for a plurality of times to print one line to perform multi-pass printing.

Figure 5:
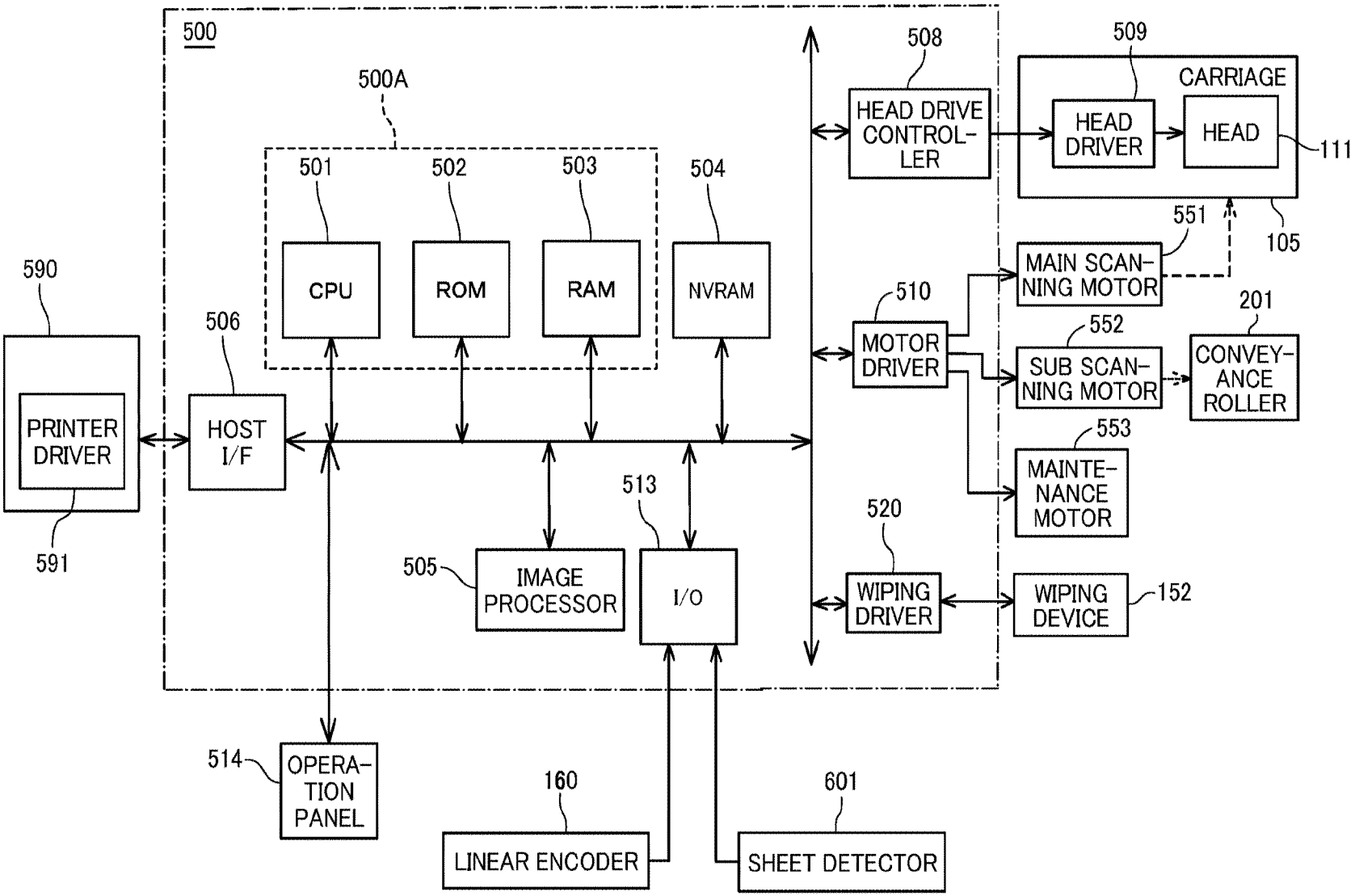
FIG. 5 is a block diagram of a controller of the liquid discharge apparatus according to the first embodiment of the present disclosure.

FIG. 5 is a block diagram of an example of a controller 500 of the printer 1 according to an embodiment of the present disclosure.

Figure 7:
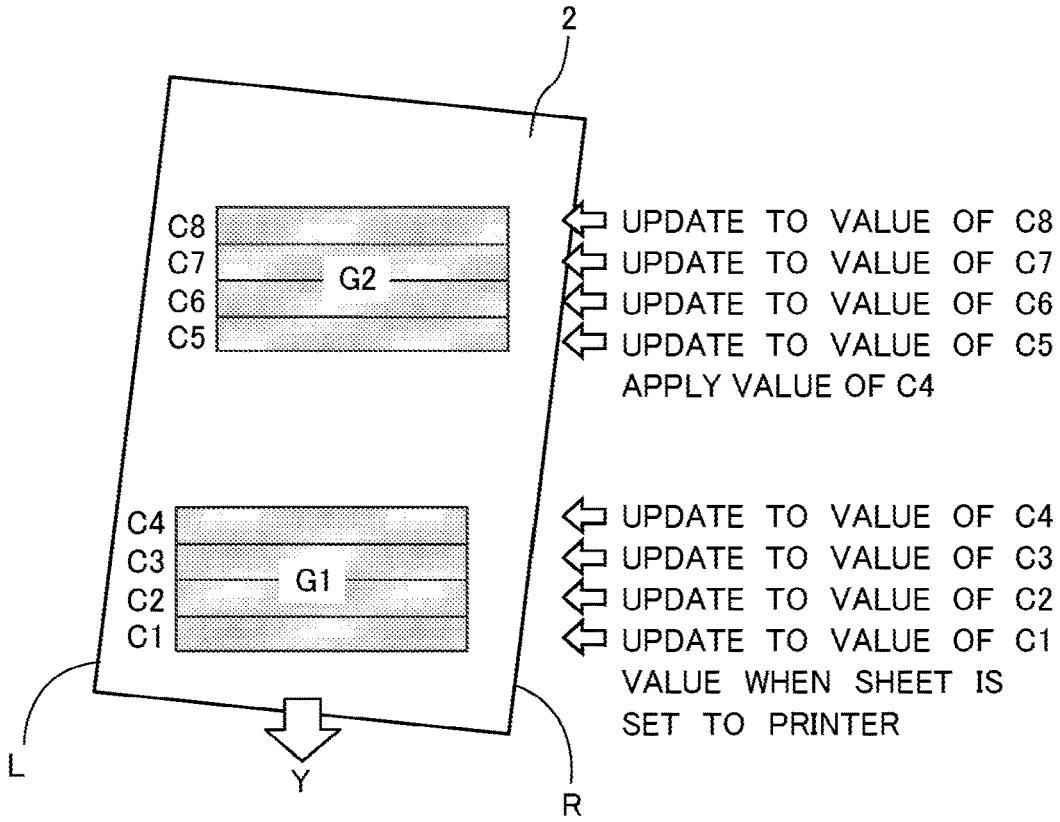
FIG. 7 is a schematic plan view of the sheet illustrating an adjustment of the print start position (image-formation start position) according to the first embodiment of the present disclosure.

As illustrated in FIG. 7, the controller 500 includes a main controller 500A that includes a central processing unit (CPU) 501, a read-only memory (ROM) 502, and a random access memory (RAM) 503. The CPU 501 administrates the control of the entire printer 1. The ROM 502 stores fixed data, such as various programs including programs executed by the CPU 501, and the RAM 503 temporarily stores image data and other data. The main controller 500A also serves as a control unit to control the printer in the first embodiment of the present disclosure.

The controller 500 further includes a non-volatile random-access memory (NVRAM) 504 and an image processor 505. The NVRAM 504 is a rewritable memory capable of retaining data even when an apparatus (printer 1) is powered off. The image processor 505 processes various signals on image data, performs sorting or other image processing, and processes input and output signals to control the entire apparatus (printer 1).

The controller 500 includes a data transfer to drive and control the head 111, a head drive controller 508 including a drive signal generator, and a head driver (driver IC) 509 to drive the head 111 on the carriage 105.

The controller 500 includes a motor driver 510 that drives a main-scanning motor 551 that moves and scans the carriage 105, a sub-scanning motor 552 that drives the conveyance roller 201, and a maintenance motor 553 that moves (elevates) the caps 151 and drives a suction device of the maintenance unit 150.

The controller 500 also includes a wiping controller 520 that drives the wiper 152.

The controller 500 includes an I/O unit 513. The I/O unit 513 acquires information from a detection output of sheet detector 601, and various types of sensors mounted on the apparatus (printer 1) such as a temperature sensor. The I/O unit 513 also extracts data for controlling the apparatus (printer 1) and uses extracted data to control the apparatus (printer 1).

Further, the controller 500 is connected to an operation panel 514 to input and display information necessary to operate the apparatus (printer 1).

The controller 500 further includes a host interface (I/F) 506 to transmit and receive data and signals to and from, e.g., a printer driver 591 of a host 590. The controller 500 uses the I/F 506 to receive the data and signal from the printer driver 591 of the host 590 such as an information processing device such as a personal computer, an image reading device, or an imaging device via a cable or a network.

The CPU 501 of the controller 500 reads out and analyzes print data in a reception buffer included in the I/F 506, performs necessary image processing, data rearrangement processing, and the like by the image processor 505, and transfers the image data from the head drive controller 508 to the head driver 509.

The head drive controller 508 transfers the above-described image data as serial data and also outputs a transfer clock, a latch signal, and a control signal, for example, necessary for transfer of the image data and confirmation of the transfer to the head driver 509.

The head drive controller 508 includes the drive signal generator including a digital-to-analog (D/A) converter to perform digital-to-analog (D/A) conversion of pattern data of drive pulse stored in the ROM 502, a voltage amplifier, a current amplifier, and the like. The head drive controller 508 generates a drive waveform including one drive pulse or a plurality of drive pulses and output to the head driver 509.

In accordance with serially-inputted image data corresponding to one line recorded by the head 111, the head driver 509 selects the drive pulses of a driving waveform transmitted from the head drive controller 508 and applies the selected drive pulses to the pressure generator to drive the head 111. Thus, the head driver 509 drives the head 111. At the time of driving the head 111, the head driver 509 selects a part or all of the drive pulses forming the driving waveform or a part or all of waveform elements forming the drive pulse. Thus, the head 111 can selectively discharge dots of different sizes, e.g., large droplets, medium droplets, and small droplets.

Figure 6:
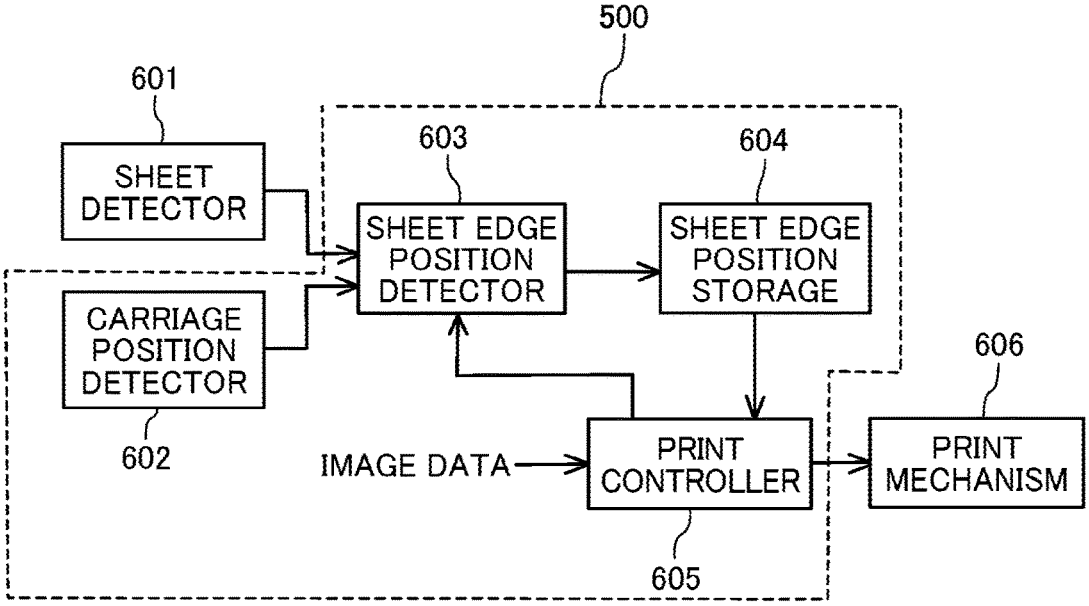
FIG. 6 is a block diagram of a part related to a control of an image position adjustment by a sheet edge position of a sheet according to the first embodiment of the present disclosure.

FIG. 6 is a block diagram of a part related to a control of an image position adjustment by an edge position of the sheet according to the first embodiment of the present disclosure.

The controller 500 includes a carriage position detector 602, a sheet edge position detector 603, a sheet edge position storage 604, and a print controller 605.

The sheet detector 601 detects presence or absence of the sheet 2.

The carriage position detector 602 detects a position of the carriage 105 (carriage position) obtained from a detection output from the linear encoder 160.

The sheet edge position detector 603 detects an edge of the sheet 2 (sheet edge) in the width direction of the sheet 2 (main-scanning direction X) from a transition state of the detection output of the sheet detector 601. The sheet edge position detector 603 further detects, as the sheet edge position, the carriage position detected by the carriage position detector 602 when the sheet edge is detected. The sheet edge position detector 603 stores data of the detected sheet edge position in the sheet edge position storage 604. The "data of the sheet edge position" is also referred to as "sheet edge position data" or "edge position data."

The sheet edge position detector 603 sets, a position at which the detection output from the sheet detector 601 changes from an absence of the sheet 2 to a presence of the sheet 2, to one of the sheet edge position (right edge position, for example) when the carriage 105 moves from a home position toward the sheet 2. The home position is set as a position at which the head 111 is capped with the cap 151 of the maintenance unit 150.

Similarly, the sheet edge position detector 603 sets, a position at which the detection output of the sheet detector 601 changes from the presence of the sheet 2 to the absence of the sheet 2, to another of the sheet edge position (left edge position, for example) when the carriage 105 moves from the home position to in the direction from the home position toward the sheet 2 side.

The sheet edge position detector 603 detects the sheet edge position for each scan in the print operation of the image. The sheet edge position detector 603 rewrites the sheet edge position data stored in the sheet edge position storage 604 to data of a latest sheet edge position for each time the sheet edge position detector 603 detects the sheet edge position. The "print operation" is an operation of discharging a liquid by the head 111 while moving the carriage 105.

If a first scan and second scan of the carriage 105 is performed without discharging the liquid, and the liquid is discharged from a third scan of the carriage 105, the third scan of the carriage is defined as "the first scan" in which the controller 500 detect the sheet edge position in the main-scanning direction X based on a detection result by the sheet edge position detector 603 while the printing device 10 prints a first scan of the image on the sheet 2.

The print controller 605 processes the image data, drives the printing mechanism 606, and controls a print operation to print on the sheet 2. The print controller 605 controls to adjust an image-formation start position (print start position) for the print operation of a next image based on a final sheet edge position obtained by the print operation of a current image. The print mechanism 606 includes the head drive controller 508, the head driver 509, the heads 111, the motor driver 510, for example, to print an image on the sheet 2.

Figure 8:
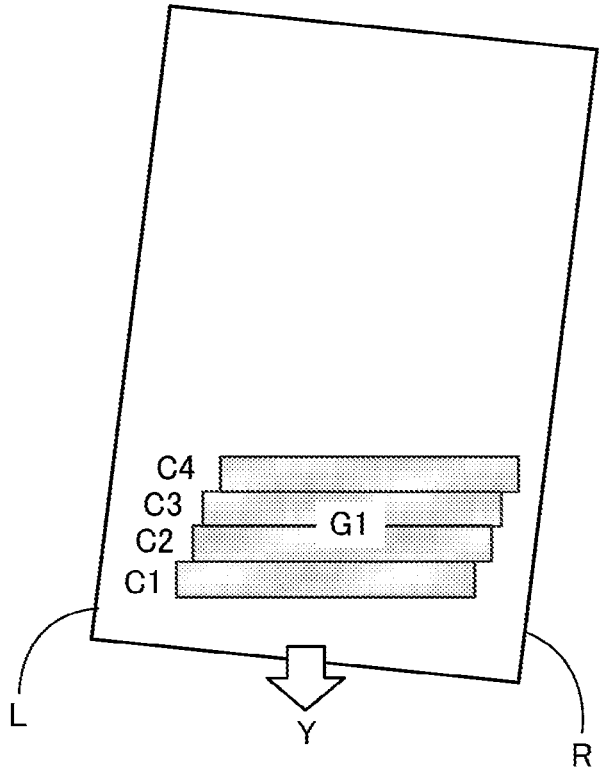
FIG. 8 is a plan view of the sheet illustrating the adjustment of the print start position when the print start position is adjusted in scan units.

Next, an overview of a print position adjustment (image-formation position adjustment) in the first embodiment of the present disclosure is described with reference to FIGS. 7 and 8. FIG. 7 is a plan view of the sheet 2 illustrating the print position adjustment. FIG. 8 is a plan view of the sheet 2 illustrating the print position adjustment when the print start position is adjusted in scan units.

As illustrated in FIG. 7, it is assumed that images G1 and G2 are sequentially printed on the sheet 2. The images G1 and G2 are printed by four scans of the carriage 105 (first scan C1 to fourth scan C4).

The image G2 (another image) is separated from the image G1 in the sub-scanning direction Y so that a space is formed between the image G1 and G2 in the sheet 2.

Then, the sheet edge position detector 603 detects a right-edge position R and a left-edge position L of the sheet 2 for each scan of the carriage 105 from the first scan C1 to the fourth scan C4. Further, the sheet edge position detector 603 updates (rewrites) a stored value of the sheet edge position to the detected (latest) value of the sheet edge position in the sheet edge position storage 604 for each time the sheet edge position detector 603 detects the sheet edge positions.

For example, in the first scan C1 of the image G1, the controller 500 determines the print position of the image G1 based on the right-edge position R detected by the sheet edge position detector 603 when the sheet 2 is set to a print position of the printer 1. The controller 500 may determine the print position of the image G1 based on a home position of the carriage 105 in the first scan C1 of the image G1. Then, the controller 500 starts printing the image G1 on the sheet 2.

The "home position" of carriage 105 is determined by a sensor on an apparatus body of the printer 1 that detects a position of the carriage 105 when the carriage 105 is at a standby position before start printing the image. The home position of the carriage 105 may be determined by a position of the carriage 105 moved a predetermined distance from a position at which the carriage 105 contacts a side plate of the apparatus body of the printer 1.

At the time of printing, the sheet edge position detector 603 detects the right-edge position R and the left-edge position L of the sheet 2 in the first scan C1 and stores the right-edge position data R and the left-edge position data L in the sheet edge position storage 604 as the last (latest) sheet edge position detected last by the sheet edge position detector 603.

Next, the controller 500 prints the image G1 by the second scan C2, and the sheet edge position detector 603 detects the sheet edge position of the sheet 2, updates (rewrite) the stored value of sheet edge position to the detected (latest) value of the sheet edge position, and stores the detected (latest) value of the sheet edge position in the sheet edge position storage 604.

Similarly, in each of the third scan C3 and the fourth scan C4, the sheet edge position detector 603 detects the sheet edge positions of the sheet 2, updates (rewrites) the stored value of the sheet edge position to the detected (latest) value of sheet edge position in the sheet edge position storage 604, stores the detected (latest) value of the sheet edge position in the sheet edge position storage 604.

Thus, the sheet edge position detector 603 updates (rewrites) and stores the data of sheet edge position detected in the fourth scan C4 in the sheet edge position storage 604 as the most upstream of the sheet edge position (the last sheet edge position of the image G1) in the conveyance direction (sub-scanning direction Y) of the sheet 2. The sheet edge position of the sheet 2 is detected in the main-scanning direction X (width direction of the sheet 2).

Thus, the sheet edge position detector 603 detects the sheet edge position of the sheet 2 in the width direction (main-scanning direction X) from the detection result of the sheet detector 601 for each scan of the carriage 105 during the print operation to print the image on the sheet 2. The sheet edge position detector 603 further stores the sheet edge position data of the detected sheet edge position while updating (rewriting) the sheet edge position data.

Then, the controller 500 adjusts the print position (image-forming position) of the image G2 (another image) based on the most upstream side of the sheet edge position (last sheet edge position) updated (rewritten) and stored in the fourth scan C4 of the image G1 when the controller 500 starts printing the next image G2. The last sheet edge position is the latest sheet edge position detected last by the sheet edge position detector 603.

Similarly, the sheet edge position detector 603 detects the sheet edge positions of the sheet 2 in the fifth scan C5 to the eighth scan C8 of the image G2, and the sheet edge position detector 603 updates (rewrites) the sheet edge position data stored in the sheet edge position storage 604 to the data of detected (latest) sheet edge position and stores the data of detected (latest) sheet edge position in the sheet edge position storage 604.

If the image G1 includes two scans of the first scan C1 and the second scan C2 without the third scan C3 and the fourth scan C4, the image G2 (another scan) starts from a third scan C3.

Similarly, the controller 500 adjusts the print start position (image-forming start position) at a time of printing next image based on the sheet edge position of a last scan of the current image.

The print start position of the first scan C1 in the image G1 is, for example, a left end of the first scan C1 when the printing is performed from left to right in FIG. 7.

The controller 500 does not adjust the print position for each scan when printing the same image (one continuous image) because the print start position (image-formation start position) of a unit image (one continuous image) corresponding to each scan may be displaced that cause deterioration in print quality as illustrated in FIG. 8. Thus, the controller 500 (circuitry) detects the sheet edge position by the sheet edge position detector 603 for each scan of the carriage 105 while stop adjusting the print start position for each scan of the carriage 105 during printing one continuous image on the sheet 2.

Figure 9:
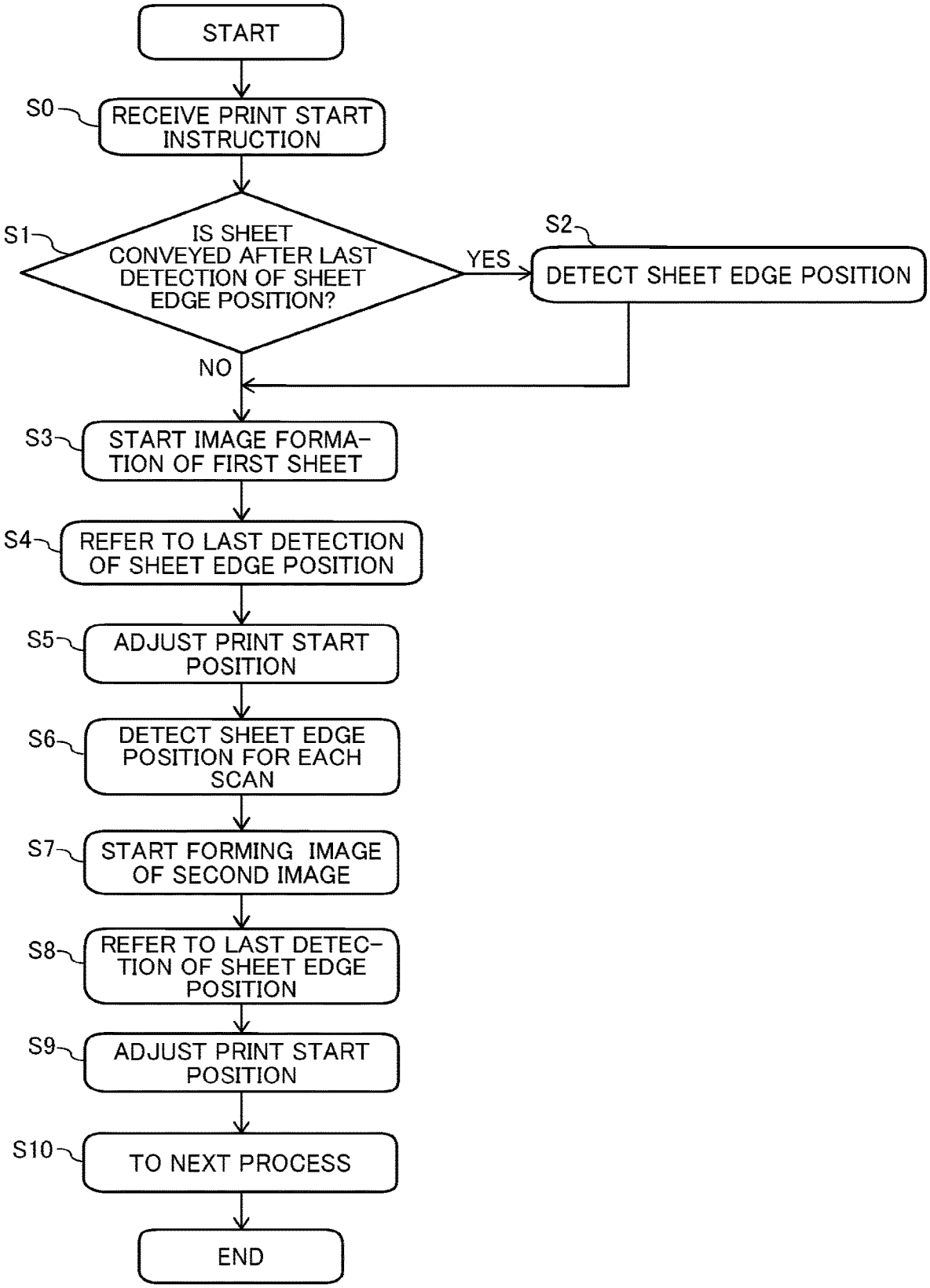
FIG. 9 is a flowchart of control of a print operation by a controller.

FIG. 9 is a flowchart of a control of the print operation of the controller 500 is described with reference to a flowchart illustrated in FIG. 9.

First, when a print start instruction is received (step S0), the controller 500 determines whether the sheet 2 is conveyed after a last detection of the sheet edge position (step S1). Hereinafter, steps S0 and S1 are simply referred to as "S0" and "S1", respectively.

The sheet edge position detector 603 detects the sheet edge position of the sheet 2 when the sheet 2 is conveyed after the last detection of the sheet edge position (S2).

The controller 500 may convey the sheet 2 described in following examples of conveyance processes (1) to (3) after printing the image G1 and before printing the image G2 in an example illustrated in FIG. 7. In the above case, the controller 500 detects the sheet edge position of the sheet 2 by the sheet edge position detector 603 before start printing the image G2. Then, the controller 500 adjusts the image-formation start position (print start position) of the image G2 based on the detected sheet edge position by the sheet edge position detector 603.

Example of Conveyance of the Sheet 2

(1) A conveyance of the sheet during the sheet 2 is set (loaded) in the printer 1.

(2) A conveyance during detection and storing of the right-edge position R of the sheet 2 in the next scan (print scan) while performing a dummy discharge operation.

The controller 500 drives the head 111 to perform the "dummy discharge operation" that discharge the liquid that does not contribute the image formation on the sheet 2 to maintain the head 111. Here, the sheet edge position detector 603 always updates (rewrites) the right-end position R of the sheet 2 (does not perform an image shift) and holds the updated (rewritten) right-edge position even when the power is turned off.

(3) A conveyance of the sheet 2 after the final detection of the right-edge position R and before start of printing process when the following at least one of conveyance processes (a) to (d) is executed.

(a) Manual feed (the user feeds the sheets 2 as many sheets as the user desires).

(b) Test feed (the sheet 2 is fed to check whether a temperature setting is appropriate).

(c) A conveyance to cut the sheet 2 at a manual cutting position.

(d) A conveyance to dry the sheet 2 after printing (including printing an adjustment chart).

Contrary, the controller 500 starts image formation of the first image (S3) when the sheet 2 is not conveyed after the last detection of the sheet edge position in step S1. At the time of starting S3, the controller 500 refers to the last detection of the sheet edge position (S4) and adjusts the image-formation start position (print start position) (S5).

Next, the sheet edge position detector 603 detects the sheet edge position for each scan while performing the print operation of the image on the sheet 2, updates (rewrites) the sheet edge position data stored in the sheet edge position storage 604 to the data of detected (latest) sheet edge position, and stores the data of detected (latest) sheet edge position in the sheet edge position storage 604 (S6).

Then, the controller 500 starts forming image of a second image (S7). At the time of start of image formation, the controller 500 refers to the last detection of the sheet edge position (S8) and adjusts the image-formation start position (print start position) (S9). Then, the controller 500 repeats the same print operation until the print operations is completed. The controller 500 proceeds to next process after completion of the print operation (S10).

Thus, the printer 1 can adjust the print start position of the image on the sheet 2 even when a skew of the sheet 2 (web) is occurred during a conveyance of the sheet 2 (web) to print the image on the sheet 2 (web) such as the roll paper or the continuous sheet. Thus, the printer can improve the print quality.

When the printer 1 enters an energy-saving mode (mode that reduces power consumption), the controller 500 does not detect the sheet edge position that is unnecessary to hold an execution history of the conveyance operation to reduce a number of detection of sheet edge position to reduce the power consumption.

When the print operation is interrupted midway and the sheet 2 is conveyed, the controller 500 adjusts the image-formation start position (print start position) based on the sheet edge position that is last to be detected by the sheet edge position detector 603 during a previous printing operation.

Thus, the controller 500 (circuitry) adjusts the print start position at which the printing device 10 starts printing the second scan of the image on the sheet 2 based on a latest edge position detected based on a last detection result by the, the sheet edge position detector 603 while the printing device 10 prints the first scan of the image, when the sheet 2 is conveyed in a sub-scanning direction Y perpendicular to the main-scanning direction X after the printing device 10 interrupts printing the first scan of the image and before the printing device 10 starts printing the second scan of the image on the sheet 2.

The above-described embodiments may be applied when the images G1 and G2 are separated by a predetermined distance (see FIG. 7). For example, the above-described embodiments may be applied when the images G1 and G2 are printed by different printing jobs, or when the images G1 and G2 are separated by a distance that is visibly recognizable that the images G1 and G2 are separated even if the images G1 and G2 are printed by the same printing job.

The sheet is a web such as a roll paper or a continuous sheet in the above-described embodiments as an example. However, the sheet is not limited to the web. For example, the web may be a recording medium (object to be printed) such as a long sheet material, a wallpaper, a sheet for electronic circuit board, or the like other than the continuous body such as the roll paper or the continuous sheet.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The terms "image formation", "recording", "printing", "image printing", and "fabricating" used herein may be used synonymously with each other.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the controller 500 as described above may be implemented by one or more processing circuits or circuitry.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A printer comprising:

a printing device to print images comprising a first image and a second image on a sheet;

a carriage to which the printing device is mounted to scan in a main-scanning direction;

a detector on the carriage to detect a presence and an absence of the sheet; and circuitry configured to:

detect a final edge position of the sheet in the main-scanning direction based on a detection result by the detector while the printing device prints a final scan of the first image on the sheet;

adjust a print start position in the main-scanning direction at which the printing device starts printing a first scan of the second image on the sheet based on only the final edge position detected in the final scan of the first image; and control the printing device to print the first scan of the second image from the print start position, wherein each of the first image and the second image is a continuous image, and the first image is separated from the second image in a sub-scanning direction by a space.

2. The printer according to claim 1, wherein the circuitry is configured to detect another edge position before the printing device starts printing the first scan of the second image on the sheet, when the sheet is conveyed in the sub-scanning direction perpendicular to the main-scanning direction after detecting the edge position in the final scan of the first image and before the printing device starts printing the first scan of the second image on the sheet.

3. The printer according to claim 1, wherein the circuitry is configured to control the printing device to start printing each of a plurality of scans of the second image from an identical print start position based on the edge position detected in the final scan of the first image.

4. The printer according to claim 1, wherein the circuitry is configured to detect the edge position for each scan of the carriage while the printing device prints the images on the sheet.

5. The printer according to claim 1, further comprising a storage to store edge position data detected by the circuitry, wherein the circuitry is configured to update the edge position data stored in the storage to a latest edge position detected based on a last detection result by the detector.

6. The printer according to claim 1, wherein the circuitry is configured to detect the edge position for each scan of the carriage and stop adjusting the print start position in the main-scanning direction for each scan of the carriage based on a latest edge position detected in a previous scan when the printer prints one continuous image on the sheet.

7. A method for printing an image on a sheet by a printing device, the method comprising:

detecting a final edge position of the sheet in a main-scanning direction based on a detection result by a detector while the printing device prints a final scan of a first image on the sheet;

adjusting a print start position in the main-scanning direction at which the printing device starts printing a first scan of a second image on the sheet based on only the final edge position detected in the final scan of the first image; and controlling the printing device to print the first scan of the second image from the print start position, wherein each of the first image and the second image is a continuous image, and the first image is separated from the second image in a sub-scanning direction by a space.

8. The method according to claim 7, further comprising:

detecting another edge position before the printing device starts printing the first scan of the second image on the sheet, when the sheet is conveyed in the sub-scanning direction perpendicular to the main-scanning direction after detecting the edge position in the final scan of the first image and before the printing device starts printing the first scan of the second image on the sheet.

9. The method according to claim 7, further comprising:

controlling the printing device to start printing each of a plurality of scans of the second image from an identical print start position based on the edge position detected in the final scan of the first image.

10. The method according to claim 7, further comprising detecting the edge position for each scan of the carriage while the printing device prints the images on the sheet.

11. The method according to claim 7, further comprising:

storing edge position data detected in a storage, and updating the edge position data stored in the storage to a latest edge position detected based on a last detection result by the detector.

12. The method according to claim 7, detecting the edge position for each scan of the carriage and stopping adjusting the print start position in the main-scanning direction for each scan of the carriage based on a latest edge position detected in a previous scan when the printer prints one continuous image on the sheet.

13. The printer according to claim 1, wherein the detector is configured to detect and update an edge position of the sheet at each scan of the carriage.

14. The printer according to claim 1, wherein the circuitry is configured to stop adjusting a print start position in the main-scanning direction for each scan, which is after the first scan, during printing the second image.

15. The method according to claim 7, wherein the detector is configured to detect and update an edge position of the sheet at each scan of the carriage.

16. The method according to claim 7, further comprising stopping adjusting a print start position in the main-scanning direction for each scan, which is after the first scan, during printing the second image.

* * * * *